US009368897B2

(12) United States Patent
Schwan

(10) Patent No.: US 9,368,897 B2
(45) Date of Patent: Jun. 14, 2016

(54) ELECTRICAL CONNECTOR

(71) Applicant: Tyco Electronics AMP GmbH, Bensheim (DE)

(72) Inventor: Ralf Schwan, Einhausen (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/556,888

(22) Filed: Dec. 1, 2014

(65) Prior Publication Data

US 2015/0087190 A1 Mar. 26, 2015

Related U.S. Application Data

(63) Continuation of application No. PCT/EP2013/061232, filed on May 31, 2013.

(30) Foreign Application Priority Data

Jun. 1, 2012 (DE) ..... 10 2012 209 298

(51) Int. Cl.

| | |
|---|---|
| ***H01R 13/426*** | (2006.01) |
| ***H01R 13/436*** | (2006.01) |
| ***H01R 13/641*** | (2006.01) |
| *H01R 13/639* | (2006.01) |

(52) U.S. Cl.

CPC ..... *H01R 13/426* (2013.01); *H01R 13/4362* (2013.01); *H01R 13/4368* (2013.01); *H01R 13/641* (2013.01); *H01R 13/6395* (2013.01)

(58) Field of Classification Search

CPC ..... H01R 13/426; H01R 13/436; H01R 13/4364; H01R 13/4365; H01R 13/4367; H01R 13/4368

USPC ..... 439/752

See application file for complete search history.

(56) References Cited

U.S. PATENT DOCUMENTS

| | | | | |
|---|---|---|---|---|
| 5,573,434 | A | 11/1996 | Ittah et al. | |
| 6,361,378 | B1 * | 3/2002 | Konoya | H01R 13/4364 439/595 |

(Continued)

FOREIGN PATENT DOCUMENTS

| | | | |
|---|---|---|---|
| DE | 102008057467 | B3 | 4/2010 |
| EP | 0727843 | A2 | 8/1996 |
| EP | 0903814 | A1 | 3/1999 |
| WO | 9749146 | | 12/1997 |

OTHER PUBLICATIONS

PCT Search Report and Written Opinion issued in co-pending International Application No. PCT/EP2013/061232, dated Aug. 26, 2013.

The First Office Action, Application No. 201280048749.2, dated Oct. 10, 2015, 9 pages.

*Primary Examiner* — Ross Gushi

(74) *Attorney, Agent, or Firm* — Barley Snyder

(57) ABSTRACT

An electrical connector is provided and includes a contact cavity, a contact receiving passageway, and a contact lock. The contact cavity includes a cavity body with a base plate provided at a longitudinal end of the cavity body and a lock receiving space provided on an opposite surface of the base plate. The contact receiving passageway extends through the cavity body and into an aperture of the base plate. The contact lock is fittable with the lock receiving space and includes a contact securing element and a lug provided on a side of the contact lock.

17 Claims, 11 Drawing Sheets

(56) References Cited

U.S. PATENT DOCUMENTS 6,558,206 B1 * 5/2003 Machida ..... H01R 13/4368 439/595
6,595,807 B2 * 7/2003 Kashiyama ..... H01R 13/4362 439/752
6,602,098 B2 * 8/2003 Sugie ..... H01R 13/4362 439/681
6,656,002 B2 12/2003 Zhao et al.
6,692,301 B2 * 2/2004 Okayasu ..... H01R 13/5208 439/587
6,699,079 B2 * 3/2004 Machida ..... H01R 13/4368 439/595
6,835,102 B2 * 12/2004 Kayama ..... H01R 13/7031 439/686
6,902,443 B2 * 6/2005 Hara ..... H01R 13/4362 439/752
6,971,924 B2 * 12/2005 Fujita ..... H01R 13/516 439/701
7,090,543 B2 * 8/2006 Lee ..... H01R 13/4362 439/489
7,195,522 B2 * 3/2007 Okada ..... H01R 13/4362 439/752
7,351,102 B2 * 4/2008 Cykon ..... H01R 13/4368 439/587
7,445,523 B2 * 11/2008 Onoda ..... H01R 13/4365 439/595
7,488,220 B2 * 2/2009 Suzuki ..... H01R 13/4362 439/686
7,500,887 B2 * 3/2009 Ichio ..... H01R 13/4362 439/595
7,556,539 B2 * 7/2009 Takahashi ..... H01R 13/4362 439/752
7,670,177 B2 * 3/2010 Myer ..... H01R 13/4365 439/595
7,976,330 B2 * 7/2011 Lin ..... H01R 4/4818 439/353
8,187,023 B1 * 5/2012 Chen ..... H01R 4/22 439/439
8,257,111 B1 * 9/2012 Smutny ..... H01R 13/5208 439/511
8,298,022 B2 * 10/2012 Tsuruta ..... H01R 13/03 439/886
8,393,911 B2 * 3/2013 Aoki ..... H01R 13/5205 439/272
8,419,485 B2 * 4/2013 Stausser ..... H01R 13/4362 439/559
8,523,594 B2 * 9/2013 Takeda ..... H01R 13/4223 439/352
8,550,860 B2 * 10/2013 Dick ..... H01R 13/4365 439/595
8,641,458 B2 * 2/2014 Matsumura ..... H01R 13/4364 439/595
8,715,016 B2 * 5/2014 DeBock ..... H01R 13/514 439/701
8,747,157 B2 * 6/2014 Tashiro ..... H01R 13/4364 439/246
8,926,363 B2 * 1/2015 Klein ..... H01R 13/582 439/587
8,926,364 B2 * 1/2015 Saitoh ..... H01R 13/4364 439/595
8,944,843 B2 * 2/2015 Keswani ..... H01R 4/4836 439/441
9,054,454 B2 * 6/2015 Gomez ..... H01R 13/631
2001/0029131 A1 * 10/2001 Fischer ..... H01R 13/514 439/752
2001/0055907 A1 * 12/2001 Murakami ..... H01R 13/4365 439/595
2002/0039863 A1 * 4/2002 Morello ..... H01R 13/4361 439/752
2002/0076996 A1 * 6/2002 Murakami ..... H01R 13/4362 439/752
2004/0242084 A1 * 12/2004 Fujita ..... H01R 13/4223 439/752
2005/0106950 A1 * 5/2005 Fink ..... H01R 13/512 439/752
2009/0053916 A1 * 2/2009 Takahashi ..... H01R 13/4362 439/152
2015/0087190 A1 * 3/2015 Schwan ..... H01R 13/4362 439/695
2015/0099404 A1 * 4/2015 Iida ..... H01R 13/506 439/752

* cited by examiner

ELECTRICAL CONNECTOR

CROSS-REFERENCE TO RELATED APPLICATIONS

This application is a continuation of PCT International Application No. PCT/EP2013/061232 filed May 31, 2013, which claims priority under 35 U.S.C. §119 to German Patent Application No.: 102012209298.6, filed Jun. 1, 2012.

FIELD OF THE INVENTION

The present invention relates to an electrical connector and, more particularly, to an electrical connector having a contact cavity and a contact lock.

BACKGROUND

Electrical connectors and connector arrangements are known in various configurations and for various uses. For example, high-voltage connectors, which power engines in motor vehicles, are known.

Furthermore, it is known that contacts arranged inside these known connector must be retained using a contact lock. The mounting and retention of these contacts are often carried out after manufacture of the connector components, but precedes a connection of the connector to a mating connector. Connection between the known connector and the mating connector cannot without first retaining the contacts using a contact lock.

SUMMARY

An electrical connector is provided and includes a contact cavity, a contact receiving passageway, and a contact lock. The contact cavity includes a cavity body with a base plate provided at a longitudinal end of the cavity body and a lock receiving space provided on an opposite surface of the base plate. The contact receiving passageway extends through the cavity body and into an aperture of the base plate. The contact lock is fittable with the lock receiving space and includes a contact securing element and a lug provided on a side of the contact lock.

BRIEF DESCRIPTION OF THE DRAWINGS

The invention is described in more detail hereinafter with reference to the drawings, in which.

DETAILED DESCRIPTION OF THE EMBODIMENT(S)

Figure 1:
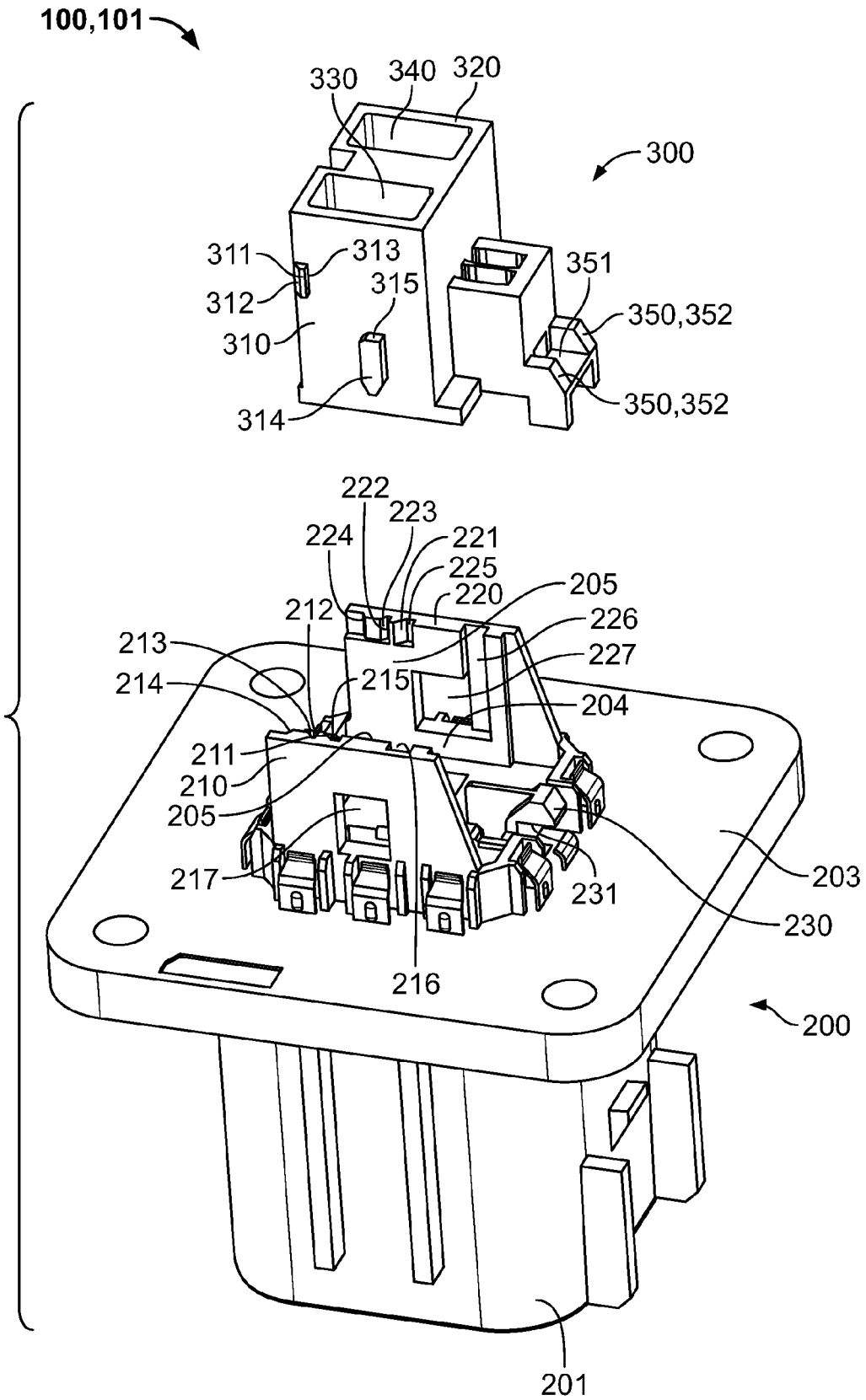
FIG. 1 shows an exploded perspective view of a connector according to the invention.

With reference to FIG. 1, a connector 100 according to the invention is shown. The connector 100 may be, for example, a high-voltage connector (HV connector). The connector 100 can, for example, serve to supply an engine unit of a motor vehicle.

The connector 100 includes a contact cavity 200 and a contact lock 300. The contact cavity 200 and the contact lock 300 are constructed as separate connectable parts 101 and shown in FIG. 1 in an exploded view. The contact cavity 200 and the contact lock 300 can each be made of plastics material and can be produced cheaply due to the simple shape.

The contact cavity 200 includes a cavity body 201, which encloses a contact receiving passageway 202 of the contact cavity 200. The contact receiving passageway 202 is constructed as a hollow space, and is visible in the cross-sectional view of FIG. 2.

A base plate 203 is provided at a longitudinal end of the cavity body 201 and constructed as a substantially rectangular plate in the embodiment shown. The cavity body 201, which encloses the contact receiving passageway 202, extends from a first surface of the base plate 203. A lock receiving space 204 is attached to an opposite surface of the base plate 203 with respect to the cavity body 201. An aperture is constructed in the base plate 203 between the lock receiving space 204 and the contact receiving passageway 202, which is enclosed by the cavity body 201.

The lock receiving space 204 includes a first leaf 210 arranged vertically on the surface of the base plate 203 and a second leaf 220 arranged parallel to the first leaf 210. The lock receiving space 204 is constructed between the first leaf 210 and the second leaf 220. The lock receiving space 204 corresponds with the contact lock 300, as will become clear hereinafter.

A side block 205 is provided on the facing surfaces of the first leaf 210 and the second leaf 220. The side block 205 guides and steers the contact lock 300 during connection there between.

The first leaf 210 includes a first guide groove 215 and a second guide groove 216. The first guide groove 215 and the second guide groove 216 extend parallel to each other from a longitudinal end of the first leaf 210 toward the base plate 203. In the shown embodiment, the second guide groove 216 is longer than the first guide groove 215, and therefore extends closer to the base plate 203. The first leaf 210 also includes a recess 217 extending completely there through, and is rectangular in the embodiment shown. The recess 217 abuts the second guide groove 216. Furthermore, the first leaf 210 includes a first locking edge 212 and a second locking edge 214. The first locking edge 212 and the second locking edge 214 are laterally offset parallel to the plane of the base plate 203 in relation to the first guide groove 215. A first chamfered edge 211 is provided between the first guide groove 215 and the first locking edge 212. A second chamfered edge 213 is provided between the first locking edge 212 and the second locking edge 214.

The second leaf 220 is symmetrically design with respect to the first leaf 210. Thus a first guide groove 225, a second guide groove 226 and a recess 227 are constructed on the second leaf 220. In addition, the second leaf 220 includes a first locking edge 222, a second locking edge 224, a first chamfered edge 221 and a second chamfered edge 223.

Furthermore, the contact cavity 200 includes a retention device 230 constructed like a hook, in the embodiment shown. The retention device 230 is arranged on an edge of the lock receiving space 204 along the base plate 203 and extends away from the lock receiving space 204. The retention device 230 has a contact surface 231, which is arranged on a side of the hook-shaped retention device 230 that is turned towards the base plate 203.

The contact lock 300 is constructed so that the contact lock 300 can be arranged in the lock receiving space 204 of the contact cavity 200 between the first leaf 210 and the second leaf 220. If the contact lock 300 is arranged in the lock receiving space 204. A first lateral surface 310 of the contact lock 300 faces the first leaf 210, while a second lateral surface 320 opposite the first lateral surface 310 faces the second leaf 220.

A first terminal receiving opening 330 and a second terminal receiving opening 340 are provided in the body of the contact lock 300, which is arranged between the first lateral surface 310 and the second lateral surface 320. The terminal receiving openings 330, 340 extend through the contact lock 300. If the contact lock 300 is arranged in the lock receiving space 204 of the contact cavity 200 then the terminal receiving openings 330, 340 extend perpendicular to a planar surface of the base plate 203 and towards a hole in the base plate 203 constructed between the lock receiving space 204 of the contact cavity 200 and the contact receiving passageway 202.

The first lateral surface 310 includes a protrusion 311. The protrusion 311 is disposed along an outer edge of the first lateral surface 310. The protrusion 311 includes a locking surface 313 orientated perpendicular to the first lateral surface 310 and a sliding surface 312, positioned opposite the locking surface 313, which is inclined at an angle of about 45° to the first lateral surface 310. Furthermore, a rib 314 is provided on the first lateral surface 310. The rib 314 is constructed as an elongated bar or web and is orientated parallel to the direction in which the contact lock 300 can be inserted into the lock receiving space 204. A blocking surface 315 is provided on an upper end of the rib 314 and orientated perpendicular to the first lateral surface 310.

The second lateral surface 320 corresponds symmetrically to the first lateral surface 310 and therefore likewise includes a protrusion and a rib, which are not visible in the drawings, however.

Furthermore, the contact lock 300 includes a lug 350 with a contact surface 351 and a chamfered edge 352. The contact surface 351 extends away from the base plate 203 of the contact cavity 200 when the contact lock 300 is arranged inside the lock receiving space 204.

Figure 2:
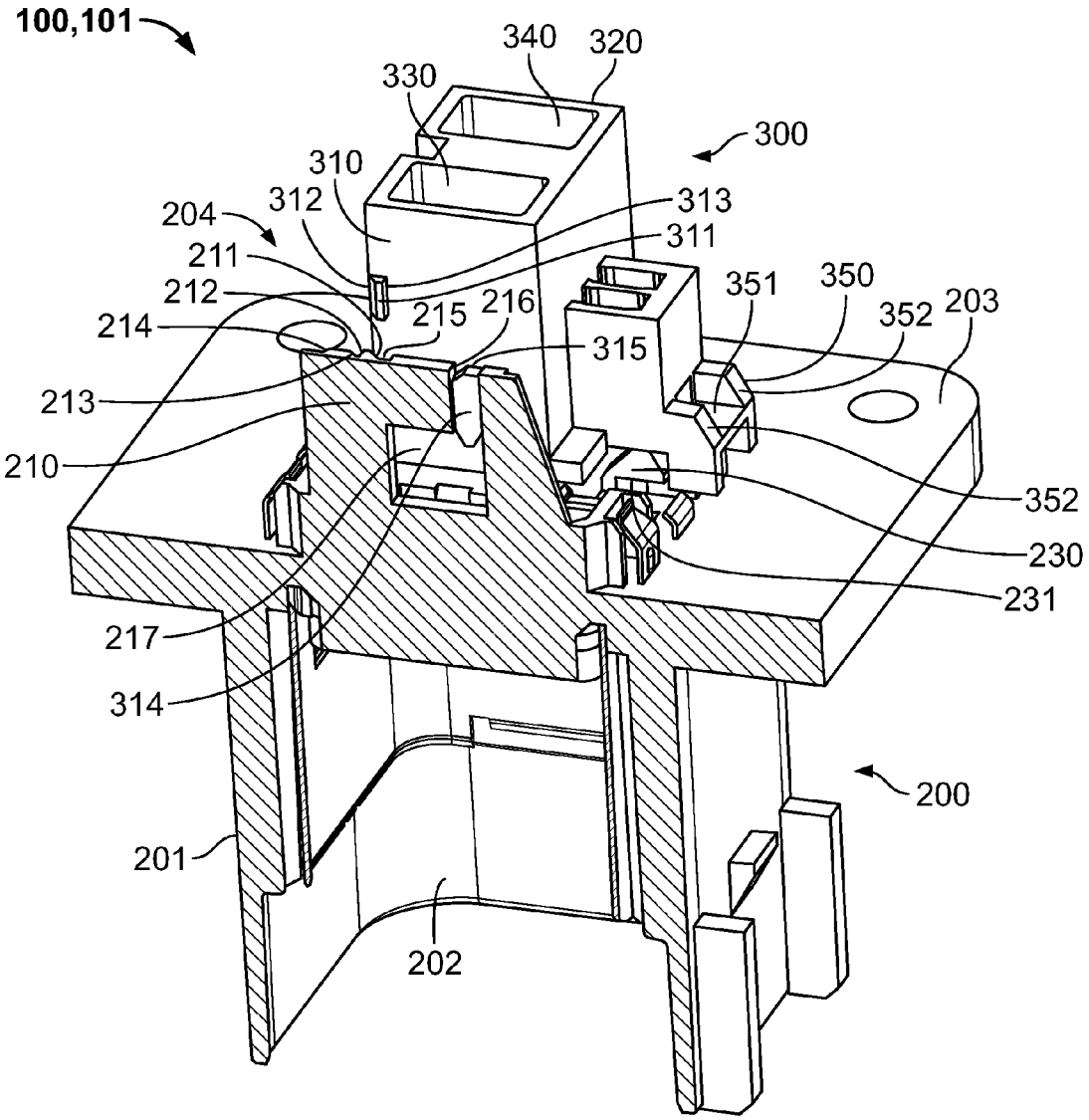
FIG. 2 shows a cross-sectional view of the connector according to the invention.

With reference to FIG. 2, the contact cavity 200 and the contact lock 300 of the connector 100 are still separate from one another. However, the contact lock 300 has already been brought closer to the contact cavity 200 and partly inserted into the lock receiving space 204 of the contact cavity 200. When the contact lock 300 has been inserted between the first leaf 210 and the second leaf 220 of the contact cavity 200, the rib 314 is guided on the first lateral surface 310 in the second guide groove 216 in the first leaf 210. Correspondingly the rib on the second lateral surface 320 is also guided in the second guide groove 226 of the second leaf 220.

Figure 3:
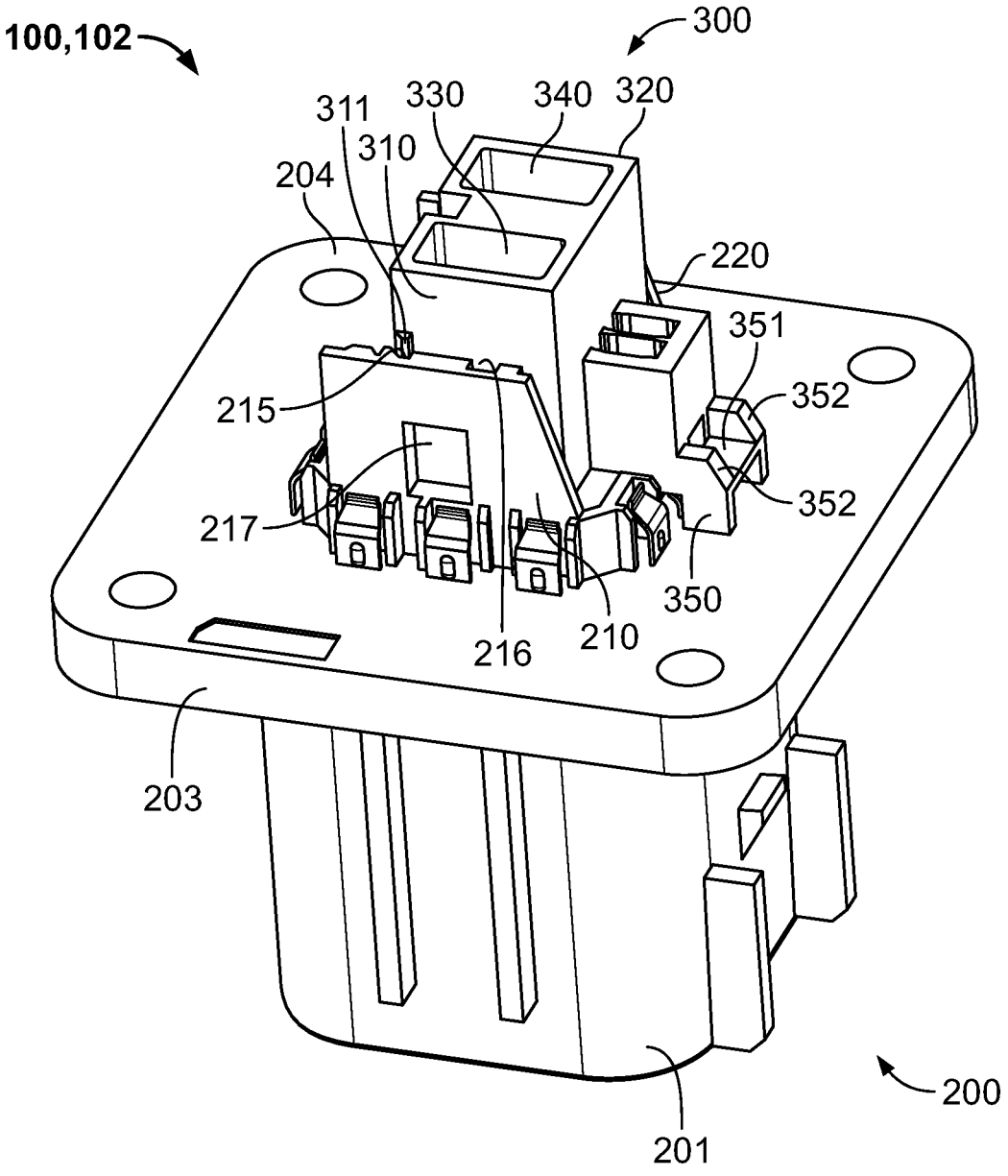
FIG. 3 shows a perspective view of the connector according to the invention.

With reference to FIG. 3, the contact lock 300 is inserted further into the lock receiving space 204 of the contact cavity 200 towards the base plate 203 and now occupies an assembly position 102. In the assembly position 102, the rib 314 is still guided on the first lateral surface 310 of the contact lock 300 in the second guide groove 216 of the first leaf 210. The rib arranged on the second lateral surface 320 is correspondingly guided in the second guide groove 226 of the second leaf 220. In addition, the protrusion 311 is now guided on the first lateral surface 310 in the first guide groove 215 of the first leaf 210. Correspondingly the protrusion on the second lateral surface 320 is guided in the first guide groove 225 of the second leaf 220.

Figure 4:
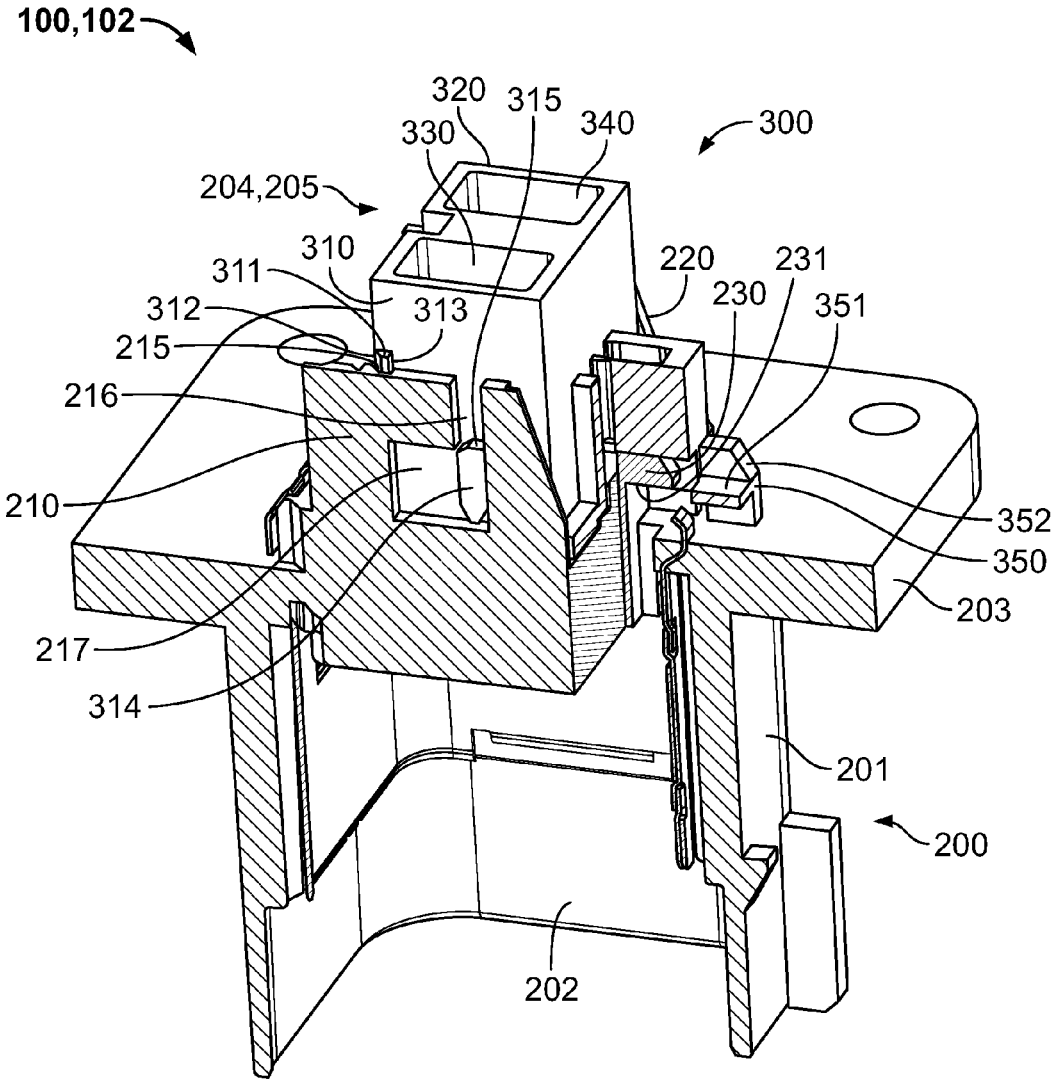
FIG. 4 shows another cross-sectional view of the connector according to the invention.

As shown in FIG. 4, the rib 314 on the first lateral surface 310 is arranged in the portion of the second guide groove 216 in the first leaf 210 abutting the recess 217 of the first leaf 210. The rib on the second lateral surface 320 is arranged correspondingly in a portion of the second guide groove 226 in the second leaf 220 abutting the recess 227 of the second leaf 220.

As the contact lock 300 moves towards the base plate 203, the lug 350 with the contact surface 351 is brought close enough to the base plate 203 such that the contact surface 351 is positioned below the contact surface 231 of the retention device 230. The contact surface 351 of the lug 350 is, however, pushed laterally towards the contact surface 231 of the retention device 230 in a direction parallel to the surface of the base plate 203.

From the assembly position 102, shown in FIGS. 3 and 4, the contact lock 300 can be taken out of the lock receiving space 204 of the contact cavity 200 again. In order to do this, the contact lock 300 must simply be raised out of the lock receiving space 204 in a direction perpendicular to the surface of the base plate 203 of the contact cavity 200. No additional steps are necessary.

Figure 5:
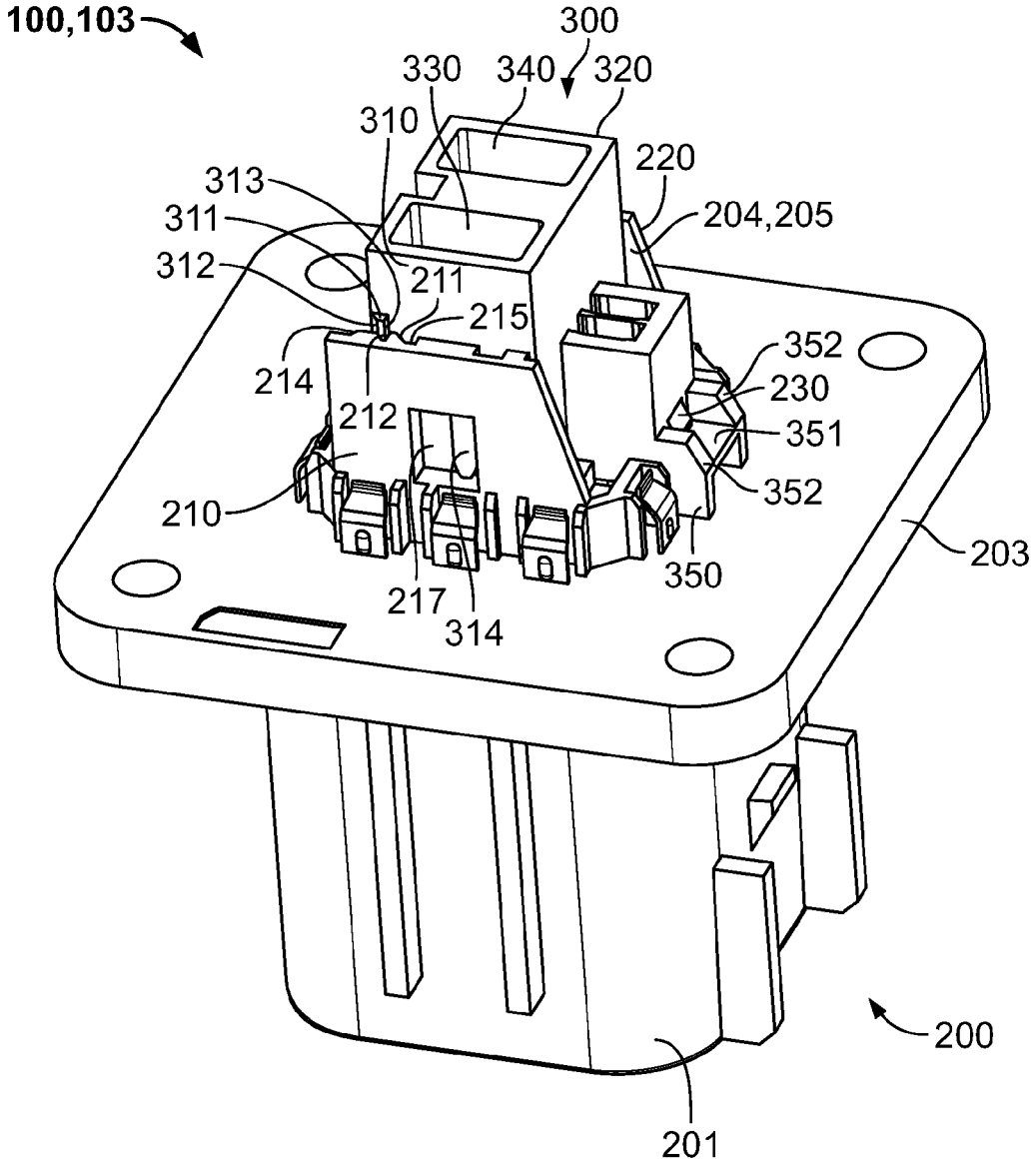
FIG. 5 shows another perspective view of the connector according to the invention.

Now with reference to FIG. 5, another perspective view of the connector 100 with the contact cavity 200 and the contact lock 300 is shown. In comparison to the situation shown in FIG. 3 the contact lock 300 has been pushed in a direction parallel to the surface of the base plate 203 between the first leaf 210 and the second leaf 220 and now occupies a pre-locked position 103.

Figure 6:
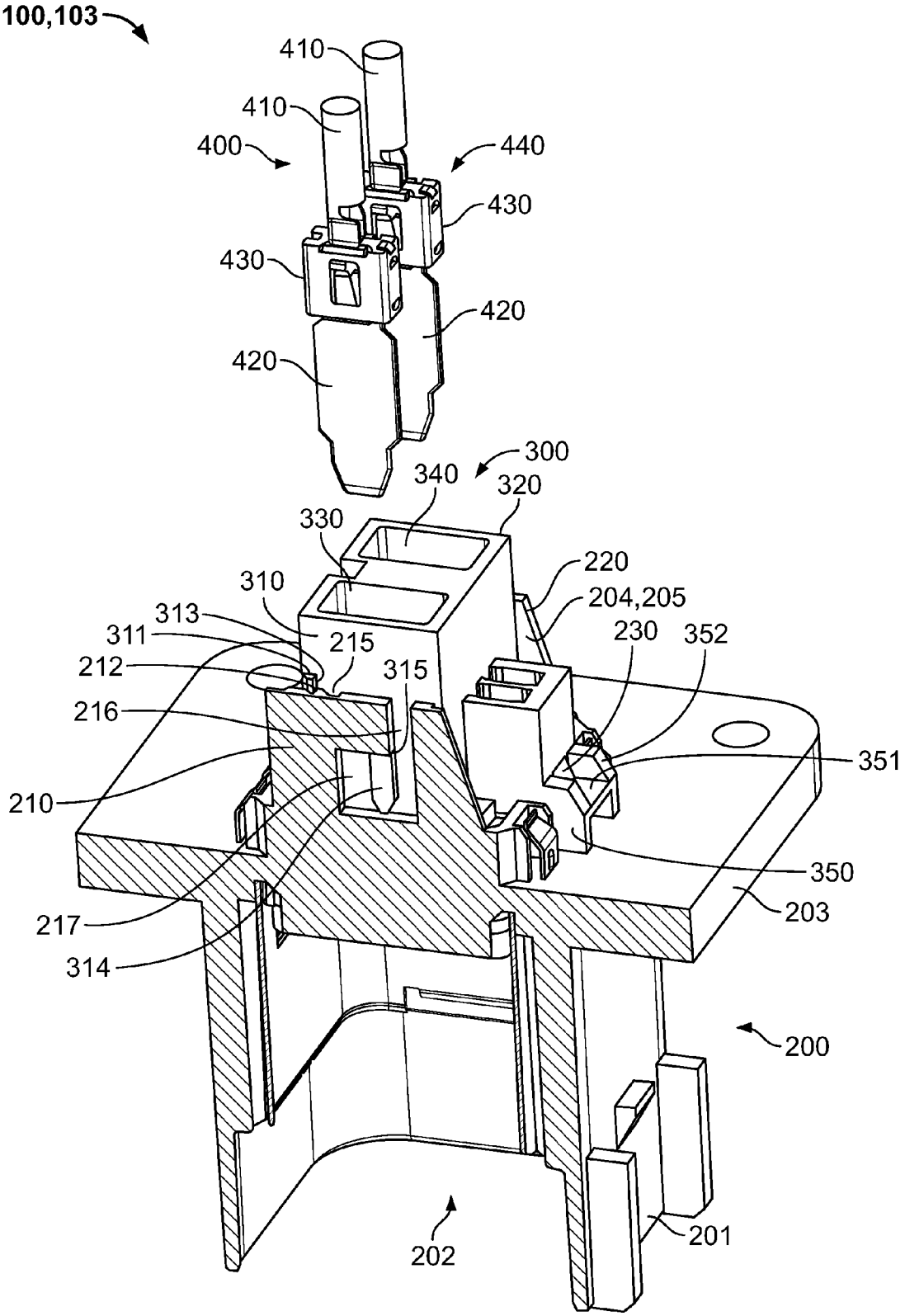
FIG. 6 shows a cross-sectional view of the connector shown in FIG. 5 with a plurality of contacts.

With reference to FIG. 6, the connector 100 with the contact cavity 200 and the contact lock 300 is shown in a pre-locked position 103.

During the movement of the contact lock 300 from its assembly position 102 into its pre-locked position 103, the protrusion 311 is pushed along the first lateral surface 310 of the contact lock 300 out of the first guide groove 215 and is then positioned with the locking surface 313 on the first locking edge 212. The relocation of the protrusion 311 is facilitated by the first chamfered edge 211 of the first leaf 210 and the first locking edge 212. The protrusion constructed on the second lateral surface 320 is correspondingly pushed out of the first guide groove 225 and is then locked onto the first locking edge 222 of the second leaf 220.

During the movement of the contact lock 300, a clearly audible clicking noise preferably occurs due to the locking of the locking surface 313 of protrusion 311 on the first locking edge 212 and the locking of the protrusion constructed on the second lateral surface 320, which has supplied a feedback signal to the person moving the contact lock 300 indicating that the pre-locked position 103 has been reached.

Since the locking surface 313 engages with the first locking edge 212 and the protrusion arranged on the second lateral surface 320, movement of the contact lock 300 out of the pre-locked position 103 is made more difficult or totally prevented. Thus the contact lock 300 cannot be moved out of the pre-locked position 103 shown in FIGS. 5 and 6 back into the assembly position 102 without a specific exertion of force parallel to the base plate 203 of the contact cavity 200. As a result an accidental separation of the contact lock 300 from the contact cavity 200 is made more difficult or totally prevented.

During lateral displacement of the contact lock 300 relative to the contact cavity 200 out of the assembly position 102 and into the pre-locked position 103, the rib 314 on the first lateral surface 310 is also pushed out of the second guide groove 216 in the first leaf 210 and into the recess 217 in the first leaf 210. Likewise, the rib arranged on the second lateral surface 320 correspondingly moves out of the second guide groove 226 and into the recess 227 in the second leaf 220. The blocking surface 315 of the rib 314 is then positioned on an edge of the recess 217 during displacement of the rib 314. Correspondingly a blocking surface of the rib on the second lateral surface 320 of the contact lock 300 is also located on an edge of the recess 227 of the second leaf 220. This prevents the contact lock 300 being removed from the pre-locked position 103 shown in FIGS. 5 and 6 and, in particular, out of the lock receiving space 204 of the contact cavity 200 in the direction perpendicular to the surface of the base plate 203 of the contact cavity 200. This also makes an accidental separation of the contact lock 300 from the contact cavity 200 more difficult or prevents it.

Figure 7:
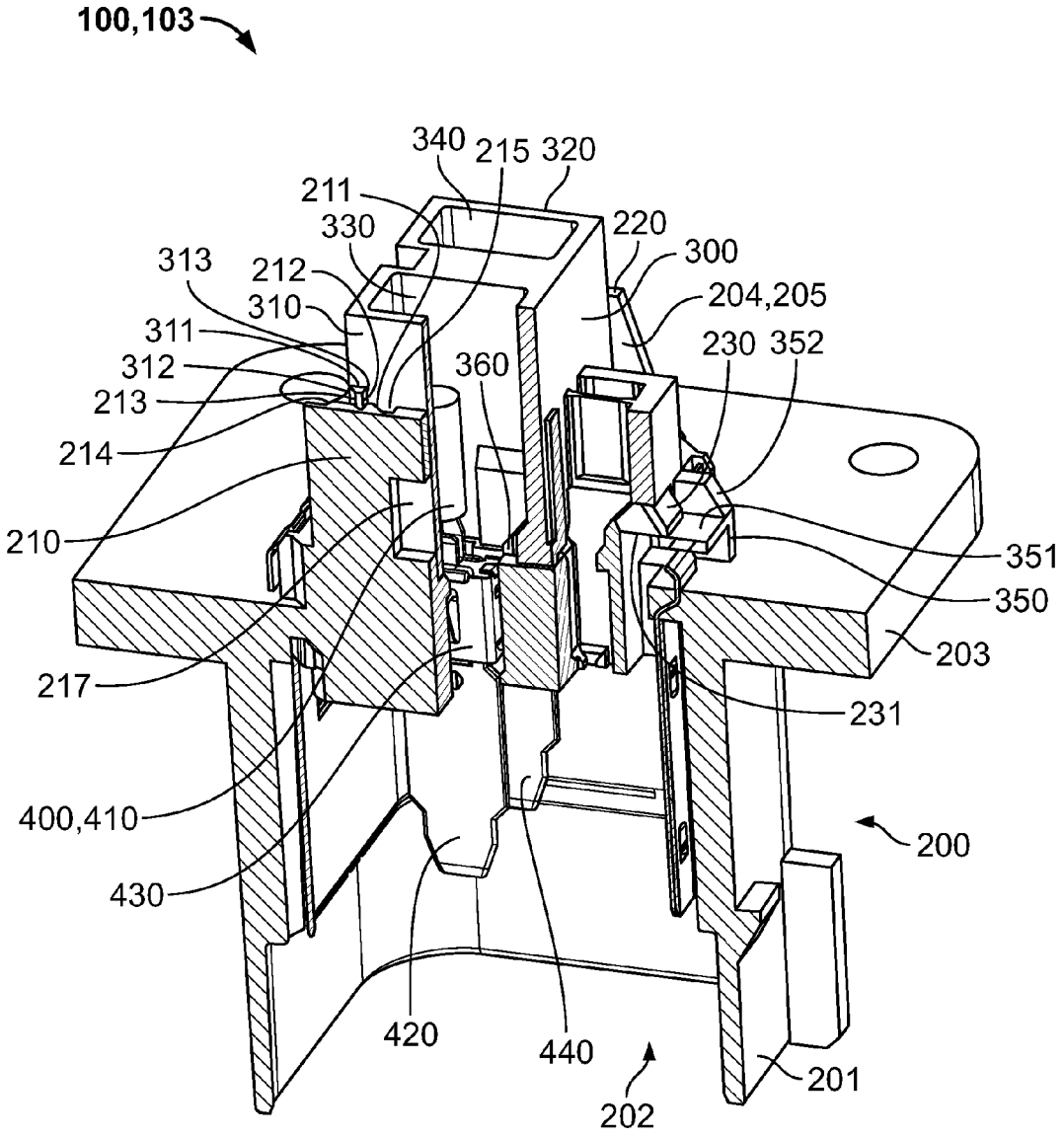
FIG. 7 shows another cross-sectional view of the connector shown in FIG. 5 with the plurality of contacts inserted therein.

With reference to FIG. 7, lateral displacement of the contact lock 300 out of the assembly position 102 and into the pre-locked position 103 is shown. The contact surface 351 of the lug 350 is arranged partially underneath the contact surface 231 of the retention device 230. This also prevents the contact lock 300 being removed from the pre-locked position 103 shown in FIGS. 5, 6 and 7 out of the lock receiving space 204.

As shown in FIG. 6, a first contact 400 and a second contact 440 are provided. Both contacts 400, 440 consist of electrically conductive material, preferably metal. The first contact 400 includes a sleeve portion 410, a blade portion 420 and a junction portion 430 connecting the sleeve portion 410 to the blade portion 420. The sleeve portion 410 is constructed as a hollow cylinder and provided to accommodate an electrically conductive contact pin. The blade portion 420 is constructed as a flat plate. The second contact 440 is of identical construction to the first contact 400.

Instead of the sleeve portion 410, a cable could also be provided, which is crimped onto the junction portion 430. The blade portion 420 is then connected to the cable in an electrically conductive manner.

The first contact 400 is intended to be inserted through the first terminal receiving opening 330 and into the contact receiving passageway 202 of the contact cavity 200. The second contact 440 is correspondingly constructed to be inserted through the second terminal receiving opening 340 of the contact lock 300 and into the contact cavity 200. In their final position the contacts 400, 440 are arranged in the contact cavity 200 in such a way that the blade portions 420 are arranged in the contact receiving passageway 202 and the sleeve portions 410 protrude into the terminal receiving openings 330, 340 of the contact lock 300. As shown in FIG. 7, the contacts 400, 440 have been inserted into the connector 100 and are located in their final position.

Figure 8:
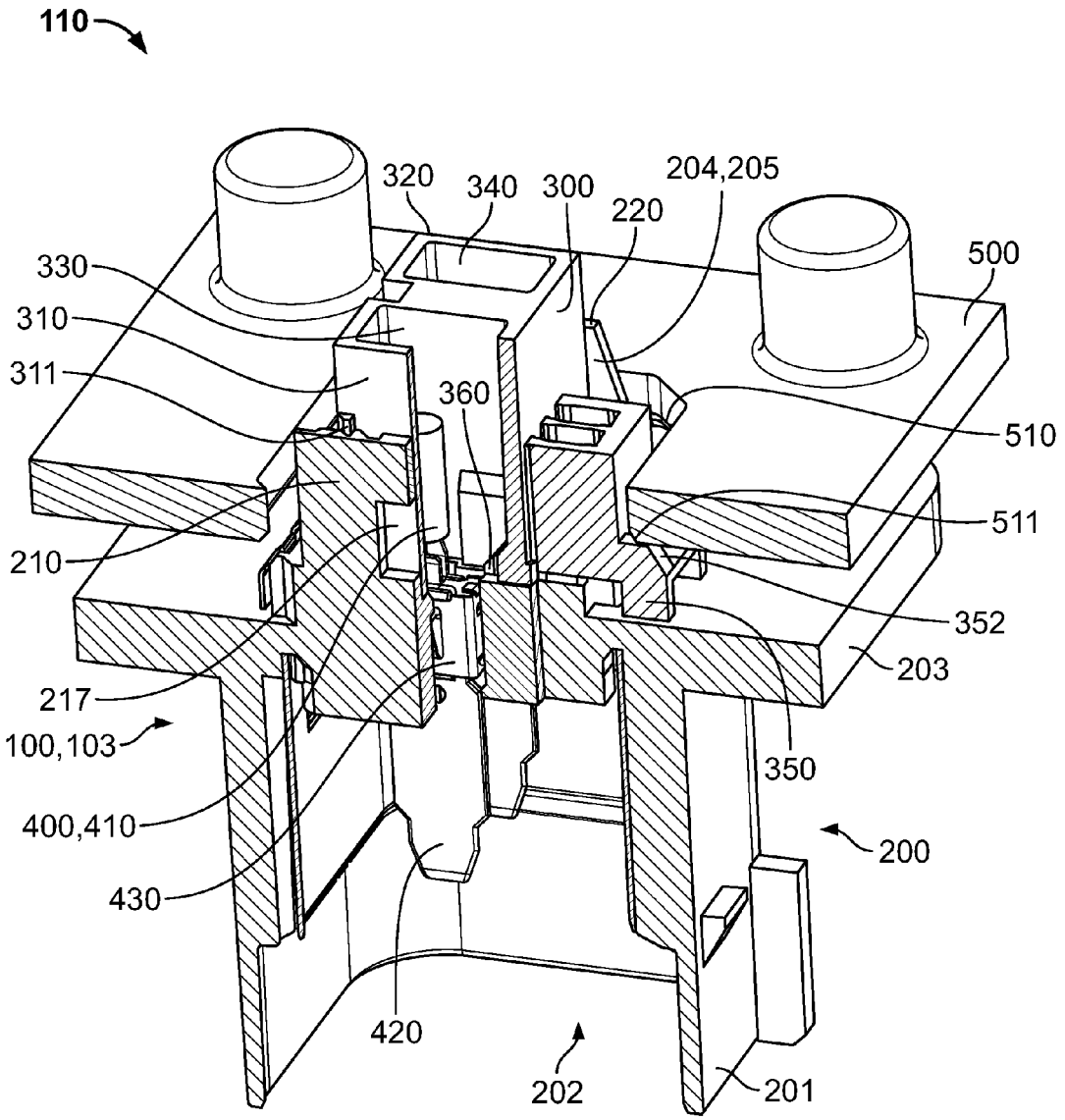
FIG. 8 shows a cross-sectional view of the connector according to the invention with a mating connector.

With reference to FIG. 8, the contact cavity 200 and the contact lock 300 are shown in a pre-locked position 103. In addition, FIG. 8 shows part of a mating connector 500. The connector 100 and the mating connector 500 together form a connector arrangement 110. The connector 100 and the mating connector 500 are intended to be plugged together in order to produce an electrical connection between the connector 100 and the mating connector 500. The mating connector 500 can, for example, be constructed on an engine of a motor vehicle. The section of the mating connector 500 shown in FIG. 8 can be a wall of this engine.

The section of the mating connector 500 shown in FIG. 8 includes an opening 510 with an edge 511 surrounding the opening 510. The opening 510 is provided to receive part of the connector 100.

As shown in FIG. 8, the contact lock 300 cannot be fully plugged together with the mating connector 500 since the edge 511 of the opening 510 of the mating connector 500 abuts the lug 350 of the contact lock 300. Thus the lug 350 prevents a plugging of the connector 100 with the mating connector 500 when the contact lock 300 is in the pre-locked position 103.

Figure 9:
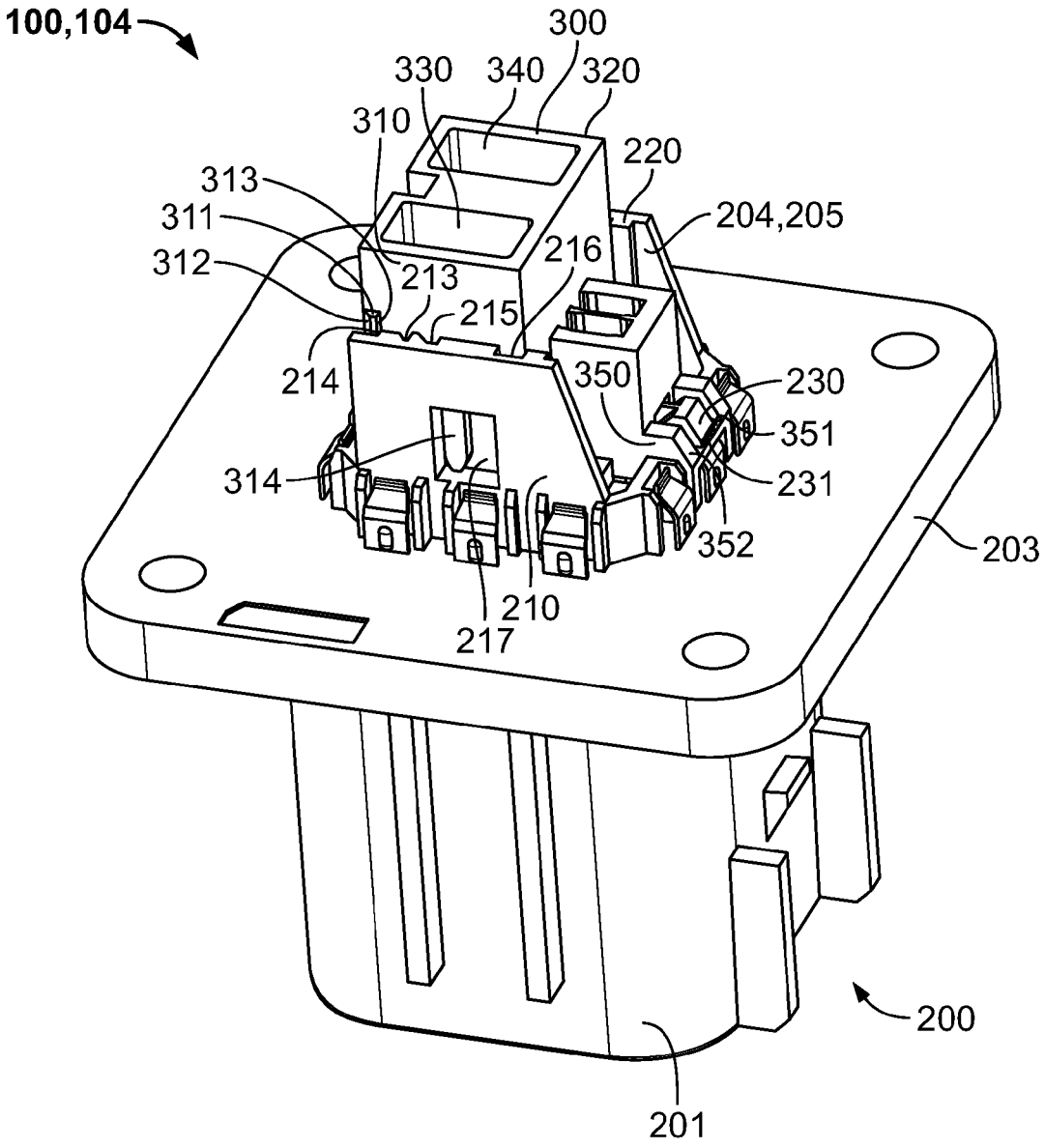
FIG. 9 shows a perspective view of the connector according to the invention.
Figure 10:
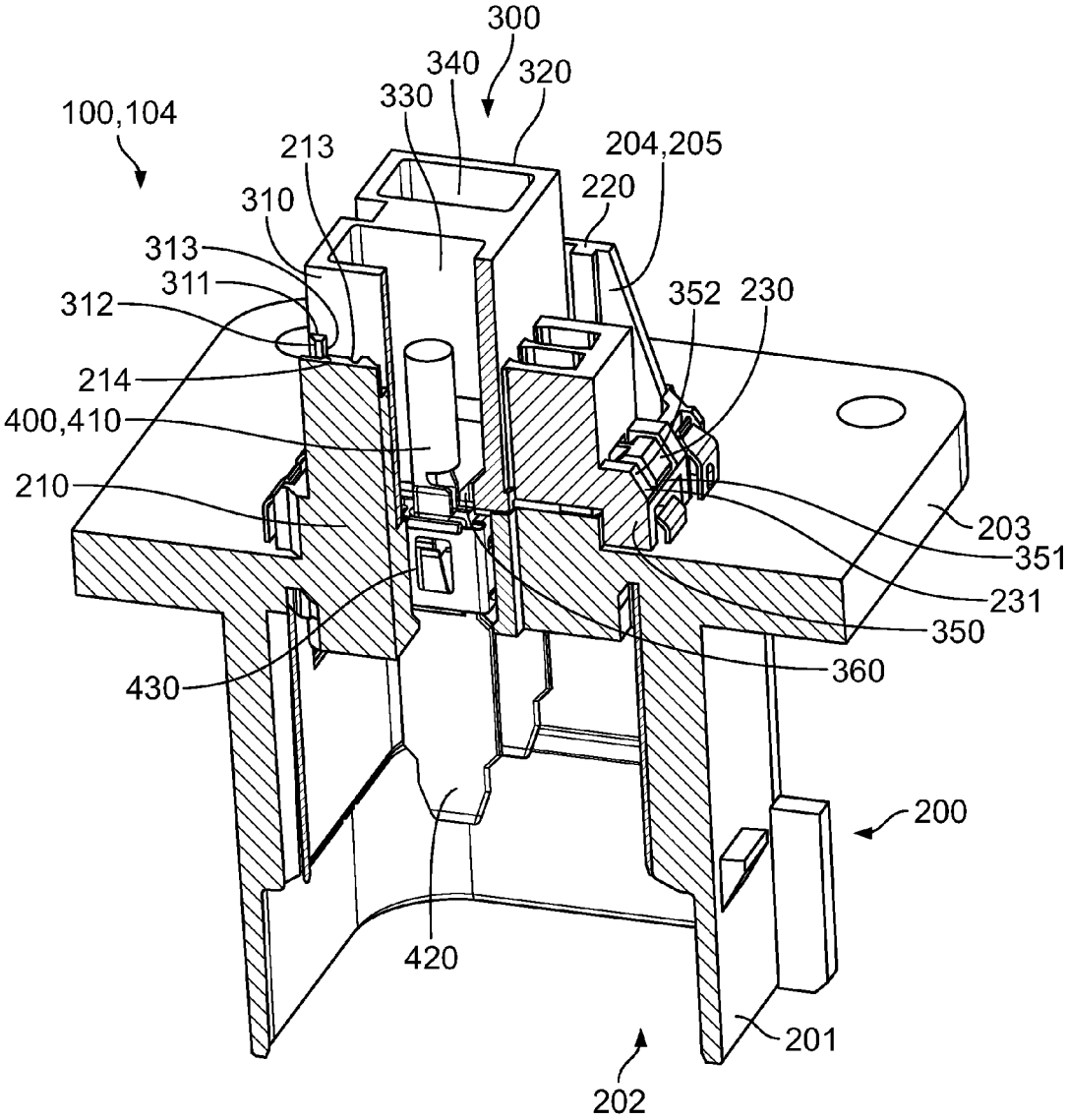
FIG. 10 shows a cross-sectional view of the connector shown in FIG. 9.

With reference to FIGS. 9 and 10, the contact cavity 200 and the contact lock 300 are arranged in the final locked position 104.

In comparison to the pre-locked position 103 of the contact lock 300 shown in FIGS. 5 to 8, the contact lock 300 in the final locked position 104 has been pushed further in a direction parallel to the surface of the base plate 203 and into the lock receiving space 204. As a result, the locking surface 313 has been released from the first locking edge 212 and is now locked on the second locking edge 214. In this case, movement of the protrusion 311 from the first locking edge 212 to the second locking edge 214 was facilitated by the second chamfered edge 213 and the chamfered sliding surface 312 of the protrusion 311. The protrusion constructed on the second lateral surface 320 of the contact lock 300 correspondingly moves from the first locking edge 222 of the side block 205 to the second locking edge 224. During movement of the protrusion 311 and the corresponding protrusion on the second lateral surface 320 and the renewed locking of the protrusion 311 and the corresponding protrusion on the second lateral surface 320, a clearly audible clicking sound has preferably occurred.

Since the second locking edges 214, 224 are chamfered in contrast to the first locking edges 212, 222, the contact lock 300 can be pushed out of the final locked position 104 shown in FIGS. 9 and 10 and back into the pre-locked position 103 shown in FIGS. 5 to 8.

In comparison to the pre-locked position 103, the ribs 314 on the first lateral surface 310 and the rib constructed on the second lateral surface 320 have been laterally displaced. However, even in the final locked position 104, the blocking surfaces 315 of the rib 314 and the corresponding blocking surface of the corresponding rib on the second lateral surface 320 are still located on the edges of the recesses 217, 227, whereby even in the final locked position 104, removal of the contact lock 300 out of the lock receiving space 204 is prevented.

It can also be seen in FIG. 10 that the displacement of the contact lock 300 out of the pre-locked position 103 and into the final locked position 104 has caused the contact surface 351 of the lug 350 to be now fully arranged below the contact surface 231 of the retention device 230. Thus, the lug 350 and the retention device 230 in the final locked position 104 lock flush to each other. As a result of the arrangement, removal of the contact lock 300 from its final locked position 104 out of the lock receiving space 204 may be prevented.

Furthermore, FIG. 10 shows that in the final locked position 104 of the contact lock 300, a contact securing element 360 of the first contact 400 is arranged inside the first terminal receiving opening 330 and is fixed to an interior of the connector 100. Another fixing element arranged in the second terminal receiving opening 340 of the contact lock 300 correspondingly fixes the second contact 440 to an interior of the connector 100 in the final locked position 104. The fixing of the contacts 400, 440 prevents the contacts 400, 440 being able to be removed through the terminal receiving openings 330, 340 and out of the connector 100 when the contact lock 300 is in its final locked position 104.

Figure 11:
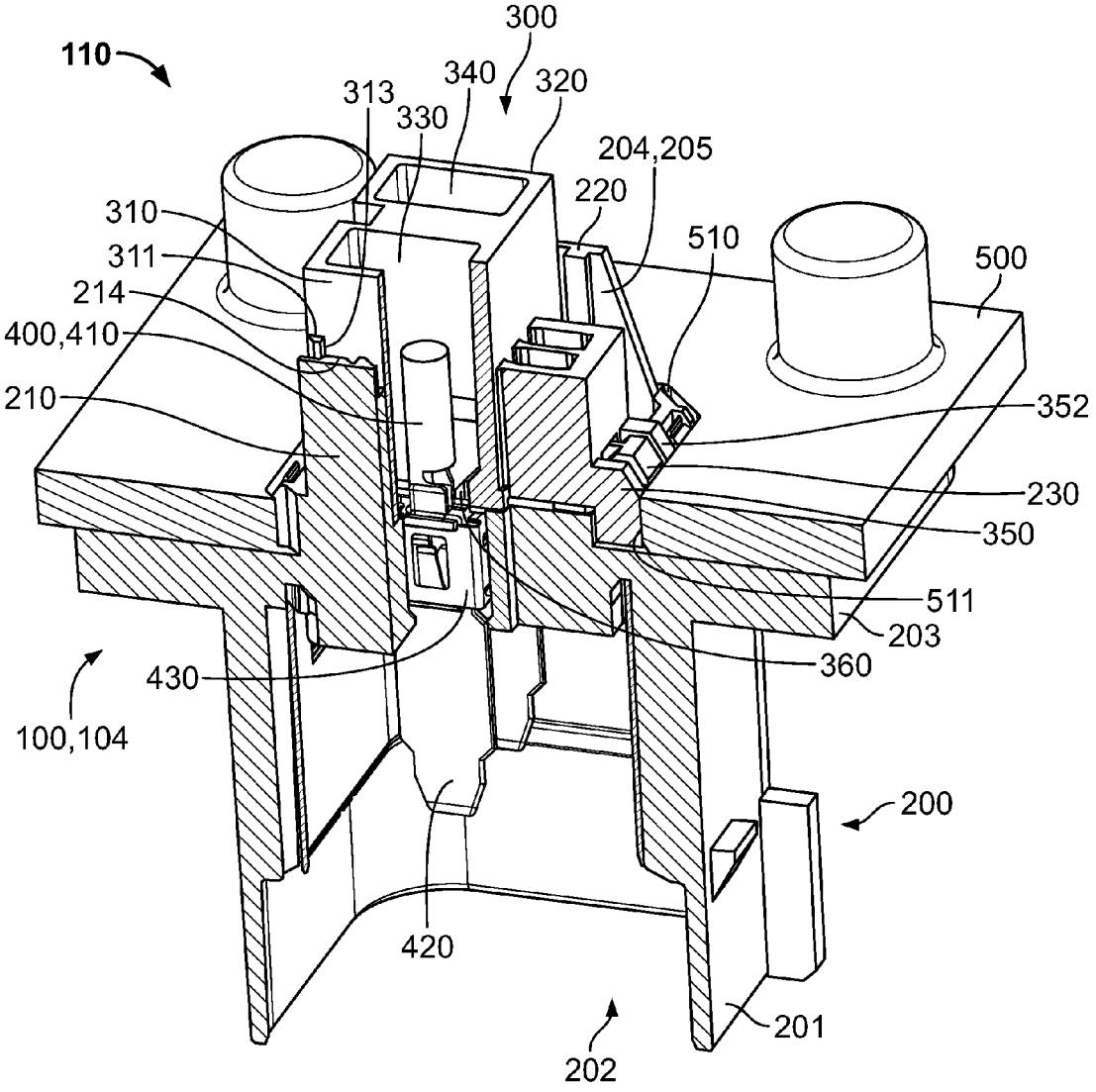
FIG. 11 shows a cross-sectional view of the connector shown in FIG. 9 connected to the mating connector.

With reference to FIG. 11, the connector arrangement 110 of the connector 100 according to the invention and the mating connector 500 is shown. The contact lock 300 is in its final locked position 104. The connector 100 is fully plugged together with the mating connector 500 in the view in FIG. 11.

In the final locked position 104, the contact lock 300 locks flush with the retention device 230 of the contact cavity 200. As a result, the edge 511 of the opening 510 does not abut the lug 350 when the connector 100 is plugged together with the mating connector 500. As shown in FIG. 8, the lug 350 prevents a plugging of the connector 100 with the mating connector 500 when the contact lock 300 is in the pre-locked position 103. In summary, this means that the connector 100 can only be fully connected to the mating connector 500 when the contact cavity 200 of the connector 100 is in its final locked position 104. This also means that the connector 100 can only be fully connected to the mating connector 500 when the contacts 400, 440 arranged inside the connector 100 are fixed by the contact lock 300, which is in the final locked position 104. As a result, the connector arrangement 110 prevents the connector 100 from connecting to the mating connector 500 before the contacts 400, 440 have been fixed in the connector 100.

When the connector 100 mates with the mating connector 500, movement of the contact lock 300 out of the final locked position 104 and into the pre-locked position 103 is prevented since the lug 350 abuts the edge 511 of the opening 510 of the mating connector 500. The contacts 400, 440 arranged inside the connector 100 are prevented from being released while the connector 100 is still connected to the mating connector 500.

In an exemplary embodiment, the chamfered edge 352 on the lug 350 causes automatic movement of the contact lock 300 out of its pre-locked position 103 and into its final locked position 104, when an attempt is made to plug the connector 100 with the mating connector 500 when the contact lock 300 is in the pre-locked position 103. In this case, the chamfered edge 352 of the lug 350, which is in the pre-locked position 103, abuts the edge 511 of the opening 510 when the connector 100 is plugged together with the mating connector 500, resulting in a force being exerted in a direction parallel to the surface of the base plate 203. This causes movement of the contact lock 300 out of the pre-locked position 103 and into the final locked position 104.

Thus, to assemble the connector 100, the contact lock 300 is initially separate from the contact cavity 200 of the connector 100 and is then arranged in an assembly position 102 in the lock receiving space 204 of the contact cavity 200. Then, the contact lock 300 is pushed laterally towards the contact cavity 200, thus moving the contact lock 300 out of the assembly position 102 and into its pre-locked position 103. In the process, a clicking sound occurs that is audible to the assembly operator. In the pre-locked position 103, the contact lock 300 is connected to the contact cavity 200 in such a manner that an unintentional separation of the contact lock 300 from the contact cavity 200 is prevented. In this pre-locked position 103, the connector 100 can now, for example, be delivered by a manufacturer of the connector 100 to a user of the connector 100.

In a further assembly step, the user of the connector 100 inserts the contacts 400, 440 into the connector 100. Then the contact lock 300 is pushed laterally towards the contact cavity 200, thus moving the contact lock 300 out of its pre-locked position 103 and into its final locked position 104. Another clearly audible clicking sound occurs. In the final locked position 104, the contacts 400, 440 are fixed in the interior of the connector 100. Then, the connector 100 can be plugged together with the mating connector 500.

If the contacts 400, 440 and/or cables connected to the contacts 400, 400 are to be replaced later, the connector 100 must first be separated from the mating connector 500. Then, the contact lock 300 can be moved out of its final locked position 104 and into its pre-locked position 103. Now the contacts 400, 440 and/or cables connected to the contacts 400, 440 can be removed from the connector 100.

Although an exemplary embodiment(s) has been shown and described, it would be appreciated by those skilled in the art that various changes or modifications may be made in the embodiment(s) without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, the embodiment(s) "comprising", "including" or "having" an element or a plurality of elements having a particular property may include additional such elements not having that property.

What is claimed is:

1. An electrical connector comprising:

a contact cavity having a cavity body with a base plate provided at a longitudinal end of the cavity body and a lock receiving space provided on an opposite surface of the base plate, the lock receiving space including a first leaf arranged vertically on a surface of the base plate and a second leaf arranged parallel to the first leaf, the first leaf including a first guide groove and a second guide groove extending toward the base in parallel and a recess extending completely therethrough;

a contact receiving passageway extending through the cavity body and into an aperture of the base plate; and a contact lock fittable with the lock receiving space and having a contact securing element and a lug provided on a side of the contact lock.

2. The electrical connector according to claim 1, wherein the lug includes a contact surface and a chamfered edge extending away from the base plate.

3. The electrical connector according to claim 1, wherein the lock receiving space is disposed between the first leaf and the second leaf.

4. The electrical connector according to claim 3, wherein the lock receiving space corresponds with the contact lock.

5. The electrical connector according to claim 3, further comprising a side block disposed on facing surfaces of the first leaf and the second leaf.

6. The electrical connector according to claim 1, wherein the second guide groove is longer than the first guide groove.

7. The electrical connector according to claim 1, wherein the recess abuts the second guide groove.

8. The electrical connector according to claim 1, wherein the first leaf further includes a first chamfered edge disposed between the first guide groove and a first locking edge.

9. The electrical connector according to claim 8, wherein the contact cavity further includes a retention device arranged on an edge of the lock receiving space along the base plate.

10. The electrical connector according to claim 9, wherein the retention device is a hook turned towards the base plate.

11. The electrical connector according to claim 9, wherein the retention device extends away from the lock receiving space and includes a contact surface arranged on a side thereof.

12. The electrical connector according to claim 8, further comprising a protrusion disposed on another side of the contact lock and corresponding with the first locking edge.

13. The electrical connector according to claim 12, wherein the side block further includes a second locking edge engageable with the protrusion.

14. The electrical connector according to claim 13, wherein the contact lock further includes a rib corresponding with the recess.

15. The electrical connector according to claim 14, wherein the rib corresponds with the second guide groove.

16. An electrical connector comprising:

a contact cavity having a cavity body with a base plate provided at a longitudinal end of the cavity body, a lock receiving space provided on an opposite surface of the base plate, and a retention device arranged on an edge of the lock receiving space along the base plate;

a contact receiving passageway extending through the cavity body and into an aperture of the base plate; and a contact lock fittable with the lock receiving space and having a contact securing element and a lug provided on a side of the contact lock.

17. An electrical connector comprising:

a contact cavity having a cavity body with a base plate provided at a longitudinal end of the cavity body and a lock receiving space provided on an opposite surface of the base plate, the lock receiving space including a first leaf arranged vertically on a surface of the base plate and a second leaf arranged parallel to the first leaf;

a contact receiving passageway extending through the cavity body and into an aperture of the base plate;

a contact lock fittable with the lock receiving space and having a contact securing element, a lug provided on a side of the contact lock, and a protrusion disposed on another side of the contact lock; and a side block disposed on facing surfaces of the first leaf and the second leaf and having a locking edge engageable with the protrusion.

* * * * *